US005078594A

United States Patent [19]

Tutt et al.

[11] Patent Number: 5,078,594

[45] Date of Patent: Jan. 7, 1992

[54] DEVICE FOR CHARGING COMBUSTIBLE SOLIDS TO ROTARY KILNS

[75] Inventors: James R. Tutt, Nash, Tex.; Michel R. Benoit, Greene, R.I.

[73] Assignees: Cadence Chemical Resources, Inc., Michigan City, Ind.; Ash Grove Cement Company, Overland Park, Kans.

[21] Appl. No.: 646,808

[22] Filed: Jan. 28, 1991

[51] Int. Cl.[5] ..... F27B 15/00; F27B 7/00; F23K 3/00

[52] U.S. Cl. ..... 432/103; 110/246; 110/346; 414/149; 414/199

[58] Field of Search ..... 432/103, 105, 106; 414/149, 199, 21; 110/246, 346

[56] References Cited

U.S. PATENT DOCUMENTS

| | | | |
|---|---|---|---|
| 2,484,911 | 10/1949 | Seil . | |
| 2,531,344 | 11/1950 | Polad . | |
| 2,617,545 | 11/1952 | Campbell . | |
| 2,813,822 | 11/1957 | Collier . | |
| 3,357,689 | 12/1967 | Arnesen et al. . | |
| 3,822,651 | 7/1974 | Harris et al. . | |
| 4,081,285 | 3/1978 | Pennell . | |
| 4,315,712 | 2/1982 | Seglias . | |
| 4,318,713 | 3/1982 | Lee et al. . | |
| 4,389,242 | 6/1983 | Baker et al. . | |
| 4,551,051 | 11/1985 | Hofbauer et al. . | |
| 4,930,965 | 6/1990 | Peterson et al. | 432/105 |
| 4,984,983 | 1/1991 | Enkegaard | 432/105 |

FOREIGN PATENT DOCUMENTS

| | | |
|---|---|---|
| 1223811 | 9/1966 | Fed. Rep. of Germany . |
| WO82/01581 | 5/1982 | PCT Int'l Appl. . |

*Primary Examiner*—Henry C. Yuen
*Attorney, Agent, or Firm*—Barnes & Thornburg

[57] ABSTRACT

An apparatus is provided for charging combustible solids through a port in the wall of a rotating kiln into a heated zone of the kiln. The apparatus includes a port closure comprising inner and outer portions which co-operate to define a passage for closure-cooling air flow when the closure is in a port-closed position. A transfer assembly is mounted on the kiln wall in alignment with the port. During kiln rotation combustible solids are loaded from a staging assembly onto the transfer assembly for alignment with the port and delivery into the kiln.

24 Claims, 4 Drawing Sheets

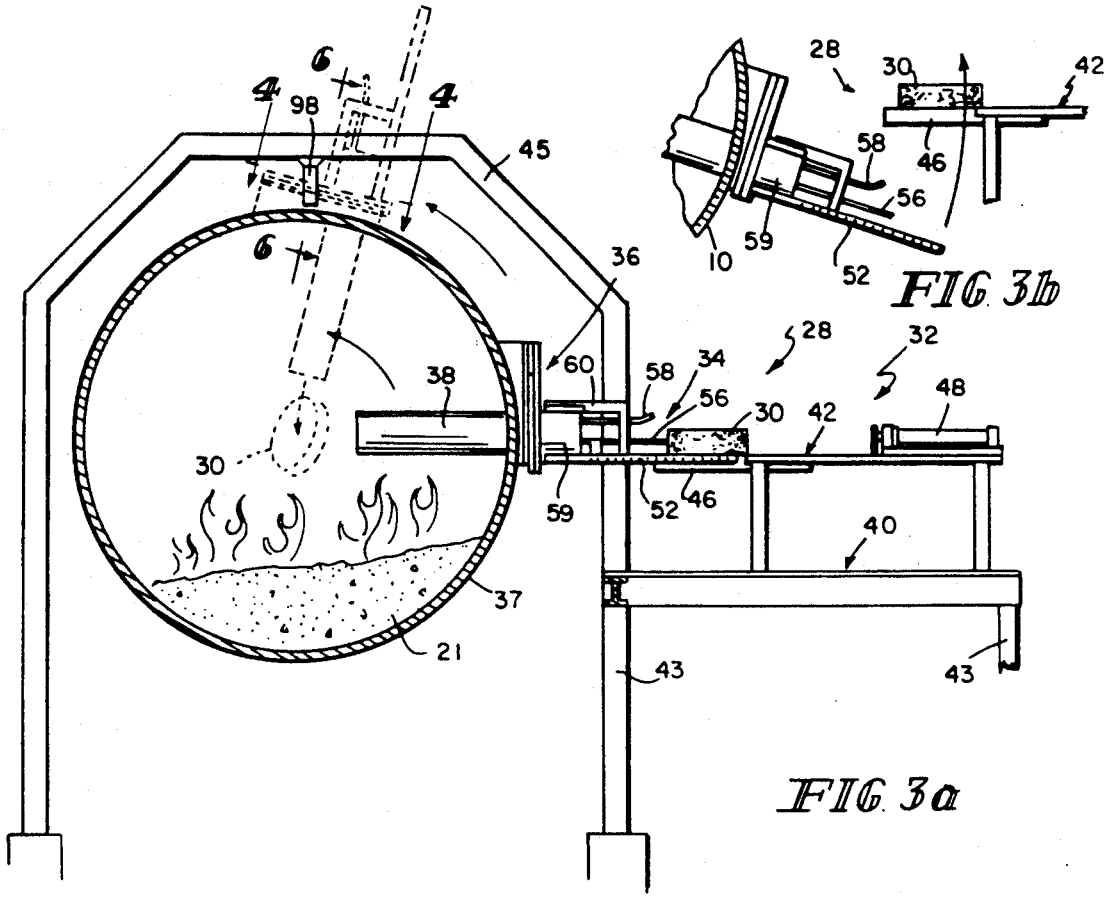
FIG. 3b
FIG. 3a
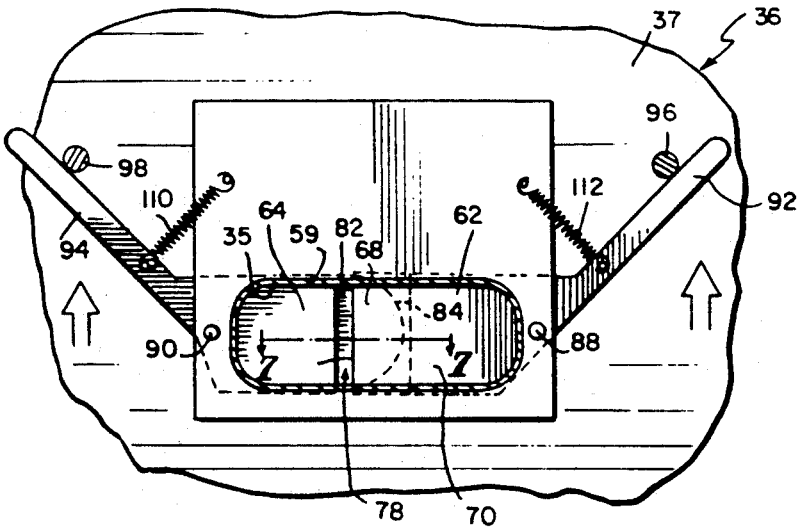
FIG. 4a

DEVICE FOR CHARGING COMBUSTIBLE SOLIDS TO ROTARY KILNS

FIELD OF THE INVENTION

The present invention relates to the burning of solid waste in rotary kilns. More particularly, this invention is directed to an apparatus for delivery combustible waste solids through a port in the cylinder wall of an operating rotary kiln.

BACKGROUND AND SUMMARY OF THE INVENTION

Cement kilns have received favorable review from both federal and state environmental regulatory agencies for disposal of both liquid and solid combustible waste. Cement kilns provide a combination of high operating temperatures and long residence times, both favorable conditions for complete combustion of organic components of waste and chemical combination of inorganic components with the reactive in-process mineral components. In spite of the availability of a wide variety of combustible waste solids as a source of inexpensive energy for the mineral processing industry, perceived engineering problems, including concerns about waste handling, end product quality and emission control, have until recently deterred kiln operators from using solid combustible waste as supplemental fuels for operating cement kilns.

For many years, regulation compliant use and disposal of wastes in operating kilns has been limited to combustible liquid or "pumpable" hazardous waste. Liquid waste materials are easily blended with each other and with conventional fuels to provide homogenous liquids that can be burned in the gaseous phase at the firing end of the kiln with little or no modification of kiln burner configuration. Solid waste, however, can occur in a multiplicity of forms, from hard crystalline solids to viscous, sticky sludges. They are not easily blended, and they present significant engineering challenges for their safe handling and delivery into rotary kilns. One solution to such problems is described in U.S. Pat. 4,850,290, issued July 27, 1989, incorporated herein by reference, which patent describes the delivery of containerized waste to both pre-heater type and conventional long wet or dry kilns at a point in the process where the kiln gas temperature is such that volatilized components are consumed with high destruction and removal efficiency. That patent also describes a device for delivering containerized waste through the wall of a kiln cylinder during kiln operation. The apparatus comprises a port, preferably with a mechanical closure, in the kiln cylinder wall; the port is aligned with a drop tube inside the kiln cylinder. The drop tube prevents hot mineral material in the kiln from escaping through the port or contacting the closure. The apparatus is utilized to deliver containerized waste into the kiln at predetermined times during kiln cylinder rotation.

Although the use of containerized solid waste in cement kilns has proven to be an economical, environmentally sound method for disposal and energy recovery from solid waste, particularly solid hazardous waste, it has been found that there are many forms or types of solid waste which need not be containerized to ensure their effective energy-saving use in operating cement kilns. Thus rubber tires, for example, have been used as an alternate source of fuel for cement kilns since 1978 in Europe and more recently in the United States.

See, for example, U.S. Pat. Nos. 4,551,051 and 4,256,503. They have been used most effectively by their delivery, as whole tires or in chipped form, into the hot transition zone between the pre-heater and the rotating kiln cylinder of pre-heater kilns.

The present invention is directed to an apparatus useful for delivering combustible solids, particularly used tires, without containerization, through a kiln cylinder wall and into a hot zone of an operating kiln. One problem presented by delivery of non-containerized combustible waste solids to operating cement kilns, which is not such a problem with containerized waste, derives from the direct contact of the combustible waste with the hot port closure immediately prior to delivery of the combustible solids into the kiln. During kiln operation the port closure can reach temperatures capable of melting or even effecting premature decomposition or combustion of the waste solids in contact with the closure. That problem is addressed in the improved charging device of the present invention by configuring the closure to have inner and outer portions defining a passageway for directed closure cooling air flow into the kiln.

Thus, according to one embodiment of the present invention, an apparatus is provided for charging combustible solids through a port in the wall of a rotating kiln into the heated zone of the kiln. The apparatus comprises means for positioning combustible solids for passage through the port, a closure for the port, and means for moving the closure between a port-closed position and a port-opened position. The closure comprises an outer portion and an inner portion which portions cooperate, at least when the closure is in the port-closed position, to define a passage in air-flow communication with both the heated zone of the kiln and ambient air. The flow of air through the passage cools at least part of the surface of the outer portion of the closure to minimize premature volatilization or decomposition of combustible solids positioned against the closure for passage through the port. Preferably, the inner and outer portions are independently movable between positions corresponding to port-opened and port-closed positions.

A drop tube extending from the port into the heated zone of the kiln prevents hot mineral material in the kiln from escaping through the port or contacting the closure. Preferably, the drop tube and port are sized to receive whole tires. In another preferred embodiment, the present apparatus includes a stationary staging assembly for supporting combustible solids before delivery to the kiln and a transfer assembly mounted on the kiln wall for receiving solids from the staging assembly and aligning them with the port in the kiln wall.

BRIEF DESCRIPTION OF THE DRAWINGS

FIG. 3*a* is a cross-sectional view taken along line 3—3 of FIG. 1.

FIG. 3*b* is similar to FIG. 3*a* showing the present apparatus and broken-away portion of the kiln cylinder at another point of rotation.

FIG. 4a is a cross-sectional view taken along line 4—4 of FIG. 3a showing the closure in the port-closed position.

FIG. 7 is an enlarged cross-sectional view of the air-cooled closure taken along line 7—7 of FIG. 4a.

DETAILED DESCRIPTION OF THE PREFERRED EMBODIMENT

This invention is directed to an apparatus for charging combustible solids through a port in the cylinder wall of an operating rotary kiln, more specifically, an operating cement kiln, at a point where the charged solids contact calcining in-process mineral. The apparatus comprises a closure for the port, the closure being moveable between a port-closed position and a port-opened position. The closure includes outer and inner portions which cooperate when the closure is in the port-closed position to define a passage in air-flow communication with both the heated zone of the kiln and ambient air. Ambient air flowing into the kiln through the passage and into the drop tube cools the closure, particularly the outer portion of the closure which contacts the combustible solids prior to their delivery into the kiln. The apparatus also includes means for moving the closure between the port-closed position and the port-opened position as the kiln is rotated through a pre-determined arc. Preferably the inner and outer portions are independently moveable inner and outer closure plates which overlap to define the passage for closure-cooling air flow. Preferably the closure portions are yieldably biased toward the port-closed position.

Extending from the port into the heated zone of the kiln is a drop tube which prevents in-process mineral from contacting the inner portion of the port closure. Further, mounted on the exterior of the kiln cylinder there is provided means for positioning the combustible solids for passage through the port, preferably a transfer assembly which is mounted in alignment with the port and further mounted to cooperate with a stationary staging assembly for transferring combustible solids from the staging assembly into alignment with the port.

In a preferred embodiment, the charging apparatus is of modular construction designed so that the port-closure assembly and the transfer assembly are mounted on the kiln through common points of attachment. In yet a more preferred embodiment, the drop tube is mounted on the kiln cylinder wall through at least a portion of those same points of attachment.

Figure 1:
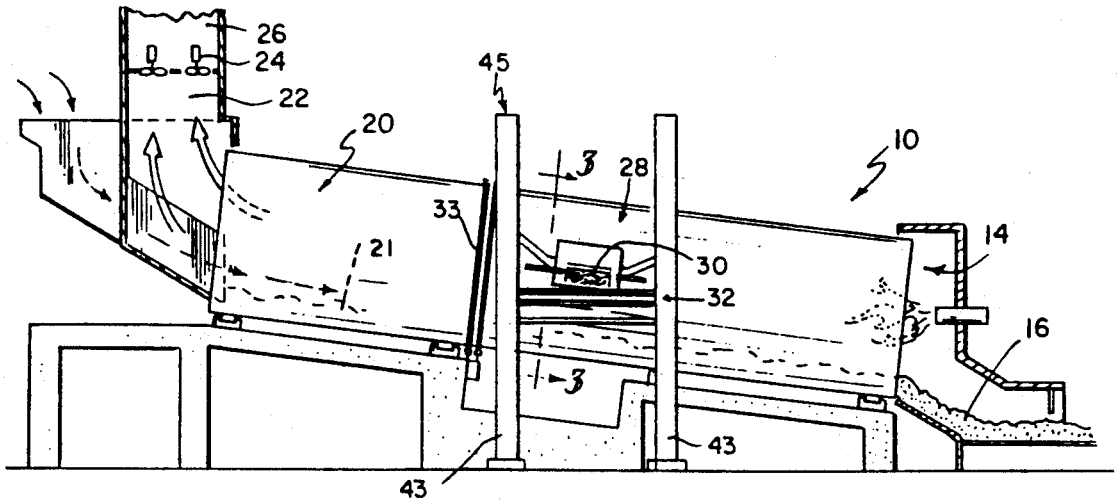
FIG. 1 is a schematic representation of a conventional rotary kiln equipped with the fuel charging apparatus of the present invention.
Figure 2:
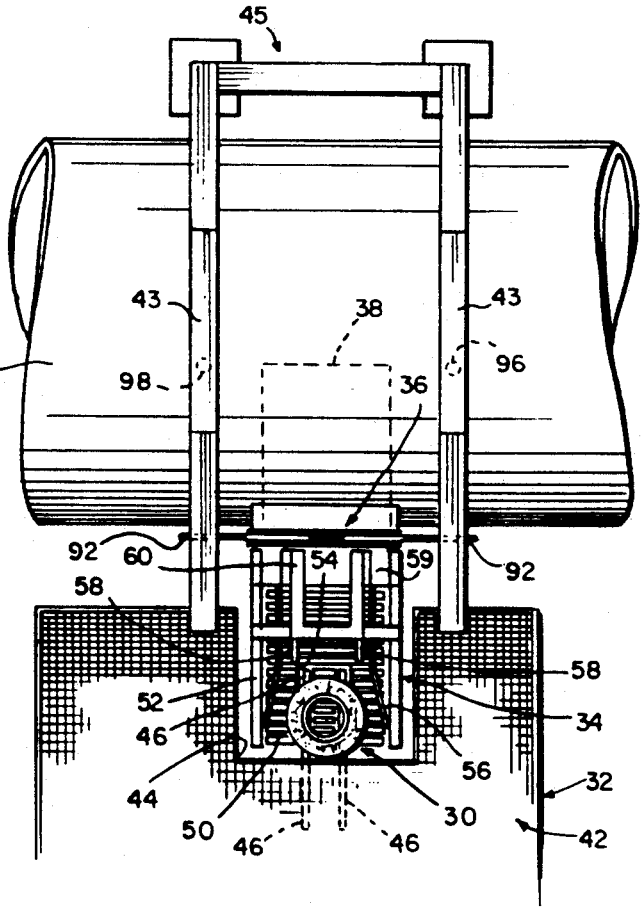
FIG. 2 is a plan view of the central portion of the kiln of FIG. 1.

FIG. 1 illustrates a conventional long dry and/or wet process kiln 10. In operation of kiln 10, mineral material is charged to the upper end 20 and forms a mineral bed 21 which moves down kiln 10 as it is rotated about its axis. The processed mineral material 16 is discharged at lower fired end 14. Exhaust gases from kiln 10 may be treated to remove particulates at emission control station 22 utilizing bag filters or electrostatic precipitators (not shown). The flow of gases through kiln 10 and out stack 26 is controlled by blowers 24.

An apparatus 28 designed for charging whole tires 30 or other combustible solids into the kiln is located along the middle one-third portion of the length of kiln 10 A thermocouple 33 is located about 10 to about 50 feet downstream (uphill) from charging apparatus 28 to monitor kiln gas temperature. Tires 30 are charged into kiln 10 through port 35 from staging assembly 32 via kiln-mounted transfer assembly 34 and port closure assembly 36.

Charging apparatus 28 includes a closure assembly 36 for port 35 (see FIG. 4a) in kiln wall 37 and a drop tube 38, a stationary staging assembly 32 and a kiln mounted transfer assembly 34. Advantageously, transfer assembly 34, closure assembly 36, and drop tube 38 are each mounted on kiln wall 37 through common points of attachment. Thus, transfer assembly 34, closure assembly 36, and drop tube 38 comprise discrete modules which can easily be removed for repair or replacement. This modular construction simplifies maintenance and reduces kiln downtime.

Staging assembly 32 includes a loading deck 40 (shown in FIG. 3a) and an elevated platform 42. Loading deck 40 is supported by beams 43 which form part of support frame 45. Elevated platform 42 is formed to include a cut-out 44 allowing clearance for kiln mounted transfer assembly 34 to pass during each kiln rotation. Projecting into cut-out 44 from elevated platform 42 are support bars 46 aligned with complementary slots 54 in transfer assembly 34. A tire 30 is positioned manually or automatically on support bars 46. As transfer assembly 34 sweeps past support bars 46 during rotation of the kiln 10, the kiln mounted transfer assembly 34 lifts tire 30 from support bars 46. As the kiln rotates to a position where the tire transfer assembly approaches its highest point, tire 30 moves under the influence of gravity and guided by adjustable guide rails 56 and retainer bars 58 toward closure assembly 36 in alignment with port 35.

As shown in FIG. 3a, elevated platform 42 can also be provided with a hydraulic ram 48 which can be actuated to move combustible waste solids across platform 42 onto support bars 46. It will be understood that an automatic feed system relying on a hydraulic ram or other waste solid handling mechanism can be used as part of or in conjunction with staging assembly 32. Such a feed system can be automated and configured to stage solids 30 on support bars 46 at predetermined times during the rotation of kiln 10. The feed system can also be interfaced with means for sensing the amount and/or timing of delivery of combustible solids added to the kiln to facilitate control of kiln operating conditions.

Transfer assembly 34 includes a segmented roller bed having a plurality of rollers 50 supported for rotation on a frame 52. As mentioned above, the segmented roller bed is formed to include slots 54 sized to allow clearance for support bars 46 so that rollers 50 can contact a tire 30 resting on support bars 46 as the transfer assembly 34 sweeps past support bars 46.

Transfer assembly 34 is provided with adjustable guide rails 56 for guiding tires 30 into alignment for delivery through port 35. Retainer bars 58, shown best in FIG. 3, are provided to retain tires 30 in alignment with port 35 during kiln rotation. Transfer assembly 34 also includes an inlet tube 59 of cross-section corresponding substantially to that of drop tube 38 and a stabilizer member 60.

Drop tube 38 extends into the heated zone of kiln 10 a distance greater than the maximum depth of mineral bed 21. Drop tube 38 communicates with port 35 in wall 37 of kiln 10 and is generally of rectangular cross-section and sized for delivery of whole tires to kiln 10.

Gas temperature in kiln 10 in the vicinity of drop tube 38 typically ranges from about 950° C. to about 1200° C. Thus, drop tube 38 must be constructed of a material which can withstand those thermally harsh conditions over long periods of time. The drop tube is preferably constructed of an alloy material protected by refractory. One alloy found suitable for construction of the drop tube is an alloy sold by Duralloy Blaw-Knox under the trademark SUPER 22-H.® That alloy is a patented high strength alloy designed for service to 2250° F. (1230° C.). Its stated chemical composition is as follows: nickel, 46–50%; carbon, 0.40–0.60%; chromium, 26.0–30.0%; manganese, 1.50% max.; silicon, 1.75% max.; tungsten, 4.00–6.00%; molybdenum 0.50% max.; cobalt, 2.50–4.00%; sulfur, 0.04% max.; and phosphorus 0.04% max.

Figure 4B:
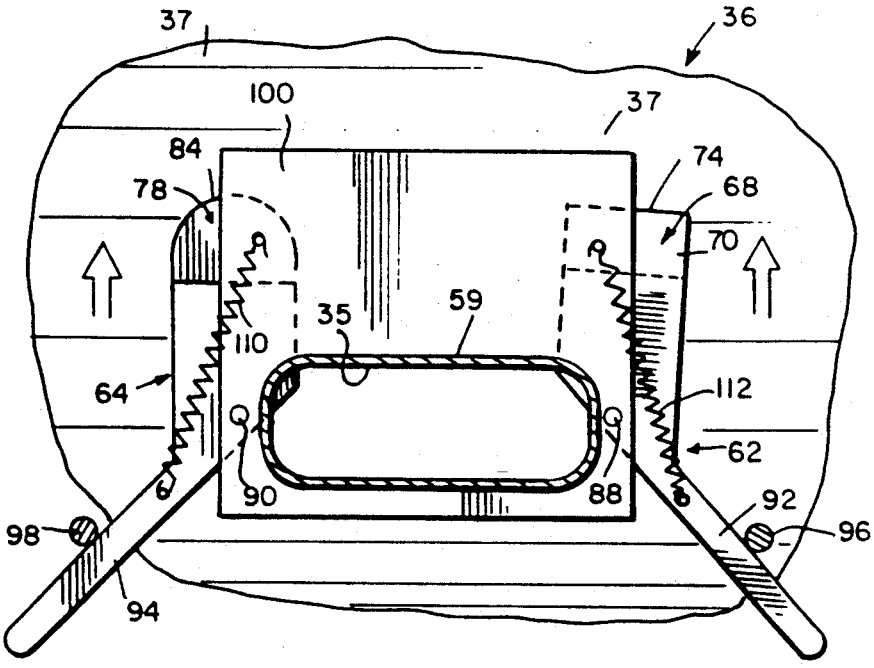
FIG. 4b shows the closure of FIG. 4a in the port-opened position.
Figure 6:
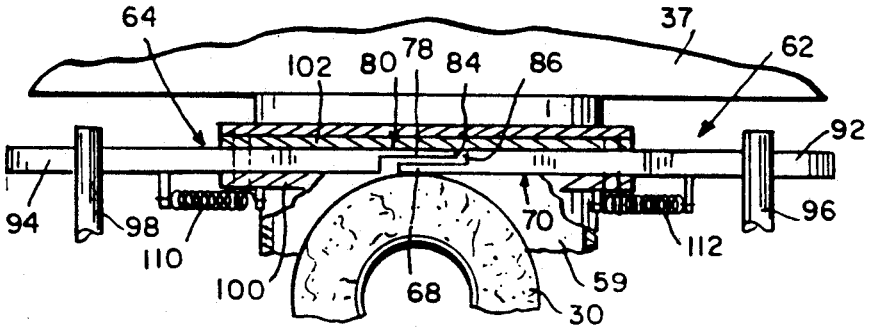
FIG. 6 is a cross-sectional view of the closure apparatus of FIG. 4a shown with a rubber tire in contact with the closure.
Figure 5A:
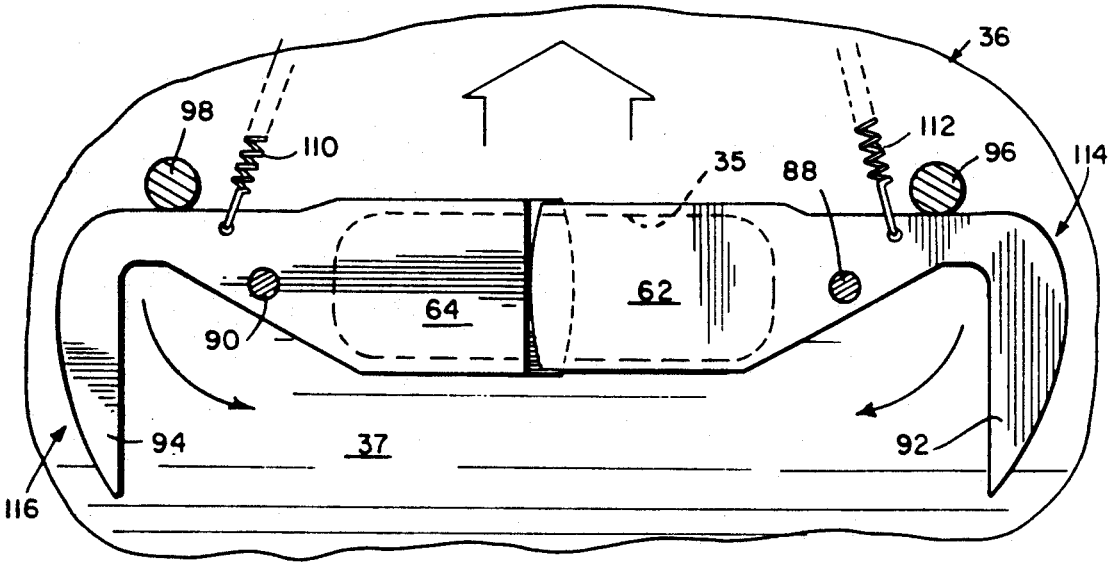
FIG. 5a is similar to FIG. 4a and illustrates another closure embodiment of the invention.
Figure 5B:
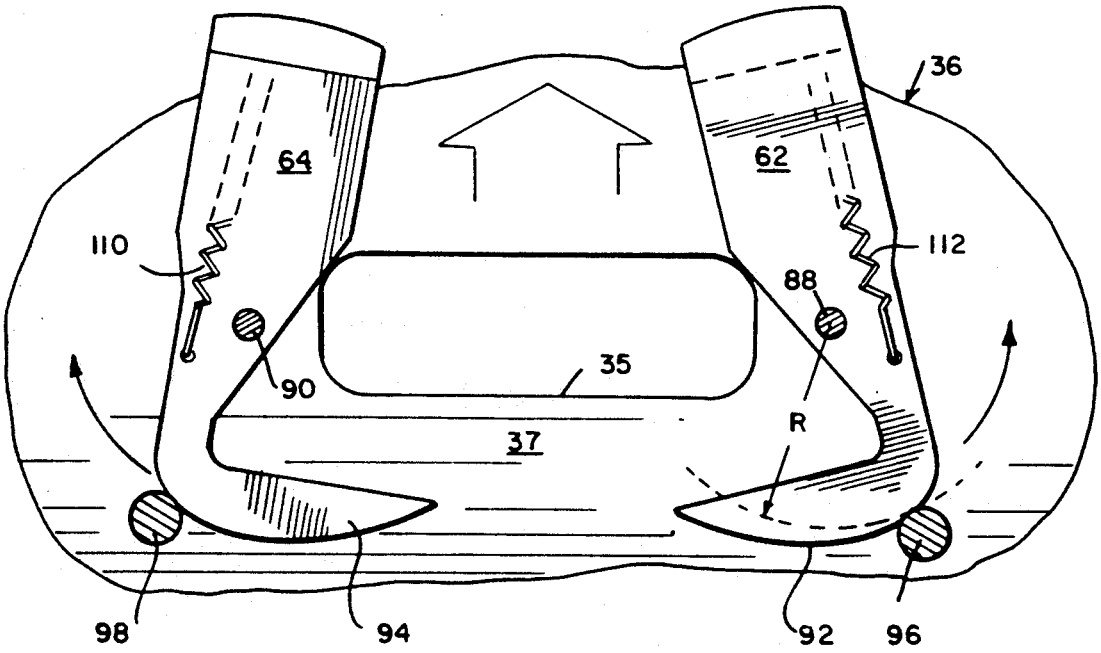
FIG. 5b shows the closure of FIG. 5a in the port-opened position.

Closure assembly 36 is shown best in FIGS. 4–6. Closure assembly includes an outer plate 62 and an inner plate 64, each pivotally mounted on kiln wall 37 and movable between a port-closed position (shown in FIGS. 4*a* and 5*a*) and a port-opened position (shown in FIGS. 4*b* and 5*b*). Flange 68 on outer plate 62 has an outer surface 70 and an opposite surface 72. Flange 68 terminates in a flat edge 74.

Figure 7:
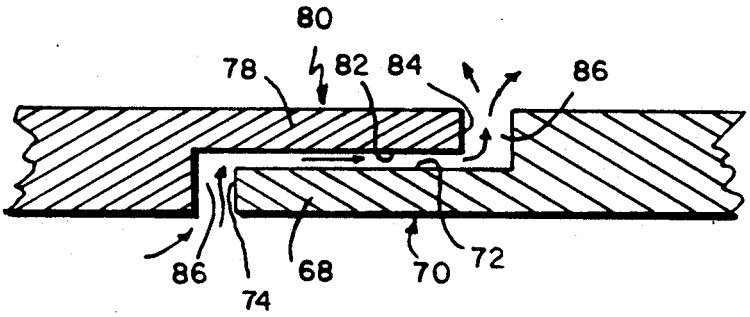

Flange 78 on inner plate 64 has an inner surface 80 exposed to the heated zone of kiln 10 and an opposite surface 82. Advantageously, flange 78 terminates in an arcuate edge 84 to provide improved clearance between inner plate 64 and outer plate 62 as the plates are moved toward a position corresponding to the port-opened position of closure assembly 36. Flanges 78 and 68 overlap when closure assembly 36 is in the port-closed position to define passage 86 in air-flow communication with both the heated zone of kiln 10 and ambient air. Ambient air flows through passage 86 into the heated zone of kiln 10 under the influence of negative pressure in kiln 10 effected by blowers 24. With reference to FIG. 7, the draft-induced flow of ambient air through passage 86 over surface 72 toward the heated zone of the kiln cools overlapping flanges 68 and 78. Thus, a cooled surface 70 is presented for direct contact with tires 30 or other combustible solids, minimizing the potential for those solids to prematurely decompose or volatilize upon contact with the closure plate.

The extent of overlap of plates 62 and 64 can be varied according to alternate design criteria. For example, outer plate 62 and inner plate 64 can be mounted in a non-coplanar, spaced-apart overlapping relationship and sized to overlap along substantially their entire extent when the closure assembly 36 is positioned in the port-closed position.

Independently movable outer closure plate 62 and inner closure plate 64 are pivotally mounted on respective pivot pins 88, 90. Each of closure plates 62 and 64 include respective lever arms 92 and 94 positioned so that as kiln 10 rotates to a point where port 35 is near its highest position, lever arms 92, 94 contact cams 96, 98 affixed to support frame 45 through a predetermined arc of rotation of kiln 10 to move outer plate 62 and inner plate 64 to the port-opened position illustrated in FIGS. 4*b* and 5*b* so that tire 30 or other combustible solids loaded onto the kiln-mounted transfer assembly 34 fall with the force of gravity through port 35 and drop tube 38 onto mineral bed 21. Cams 96, 98 can be moved from an apparatus-operating position (shown in FIG. 3) to a position in which cams 96, 98 do not contact lever arms 92, 94 during rotation of kiln 10.

As shown best in FIG. 6, outer plate 62 and inner plate 64 are pivotally mounted between two spaced-apart panels 100, 102. Panels 100, 102 are separated by spacers (not shown). Springs 110, 112 cooperate with panel 100 and levers 92, 94 to bias outer plate 62 and inner plate 64 toward the port-closed position. The panels 100, 102 also provide attachment points for the transfer assembly 34 and the drop tube 38 enabling the modular construction hereinbefore described.

A sensor (not shown) can be positioned to detect delivery of tire 30 or other combustible waste solids from transfer assembly 34 through port 35 into kiln 10. An audible, visible or electronic signal can be generated to indicate when the transfer is complete. The sensor signal can be used to trigger, for example, positioning of the next tire 30 on support bars 46 for pick up by the tire transfer assembly 34 as it sweeps past staging assembly 32 on the next rotation of the kiln.

In operation of the charging apparatus, tire 30 or other combustible waste solids are loaded from elevated platform 42 onto the support bars 46. As kiln 10 is rotated, transfer assembly 34 sweeps past support bars 46 and picks up tire 30. As kiln 10 rotates and transfer assembly reaches a near-vertical position, tire 30 moves under force of gravity across rollers 50 toward port 35 to rest against air-cooled surface 70 of outer plate 62. With rotation of kiln 10, cams 96, 98 contact respective lever arms 92, 94, moving closure assembly 36 to the port-opened position allowing tire 30 to drop through port 35 and drop tube 38 onto mineral bed 21. As the kiln 10 rotates and levers 92, 94, move past cams 96, 98, the closure is returned to the port-closed position by force of springs 110, 112 on levers 92, 94. With reference to FIGS. 5*a*, 5*b* lever arms 92, 94 are each formed to have an arcuate cam-contacting edge 114, 116 which remains in contact with respective cams 96, 98 as the kiln rotates through a short arc segment after the point in kiln rotation where closure plates 62, 64 are in their respective port-opened positions. The arcuate edges 114, 116 cooperate with cams 96, 98 as the kiln rotates through the ar segment to reduce the rate of movement of closure plates 62, 64 to their respective port-closed position under force of springs 110, 112, thereby reducing wear and maintenance costs for equipment operation.

We claim:

1. An apparatus for charging combustible solids through a port in the wall of a rotating kiln into a heated zone of the kiln, the apparatus comprising means for positioning the combustible solids for passage through the port, a closure for the port, the closure being movable between a port-closed position and a port-opened position, the closure comprising an outer portion and an inner portion, the outer and inner portions cooperating when the closure is in the port-closed position to define a passage in air-flow communication with both the heated zone of the kiln and ambient air, means for moving the closure between the port-closed and port-opened positions, and a drop tube extending from the port and into the heated zone of the kiln.

2. The apparatus of claim 1, wherein the port and drop tube are sized to receive a whole tire.

3. The apparatus of claim 1, wherein the drop tube is of substantially rectangular cross-section.

4. The apparatus of claim 1, wherein the inner and outer portions are independently movable.

5. The apparatus of claim 1, wherein the moving means includes a first lever appended to the inner portion, a second lever appended to the outer portion, and means for camming the first and second levers to move the closure to the port-opened position as the kiln rotates through a predetermined arc.

6. The apparatus of claim 1, further comprising means for yieldably biasing the closure toward the port-closed position.

7. An apparatus for controlling the entry of combustible solids through a port in the wall of a rotating kiln into a heated zone of the kiln, the apparatus comprising a closure for the port, the closure being movable between a port-closed position and a port-opened position, the closure comprising an outer portion and an inner portion, the outer and inner portions cooperating when the closure is in the port-closed position to define a passage in air-flow communication with both the heated zone of the kiln and ambient air, and mean for moving the closure between the port-closed position and the port-opened position.

8. The apparatus of claim 7, wherein the inner end outer portions are independently movable.

9. The apparatus of claim 7, wherein the inner and outer portions are moveable inner and outer closure plates, respectively.

10. The apparatus of claim 9, wherein the inner and outer closure plates overlap when the closure is positioned in the port-closed position and the passage is defined by the overlapping plates.

11. The apparatus of claim 7, wherein the inner and outer portions comprise spaced-apart closure plates of complementary configuration.

12. The apparatus of claim 7, wherein the inner and outer portions each include first coplanar plate portions and second non-coplanar plate portions and the air-flow passage is defined by the surfaces of the non-coplanar plate portions.

13. The apparatus of claim 7, wherein one of the inner and outer portions terminates in an arcuate edge.

14. The apparatus of claim 7, wherein the moving means comprises a lever appended to the closure and means for camming the lever to move the closure to the port-opened position as the kiln rotates through a predetermined arc.

15. The apparatus of claim 7, further comprising means for yieldably biasing the closure toward the port-closed position.

16. An apparatus for charging combustible solids through a port in a wall of a rotating kiln into a heated zone of the kiln, the apparatus comprising a stationary staging assembly for supporting combustible solids, a transfer assembly mounted on the kiln wall at a point in alignment with the staging assembly and the port for transferring combustible solids between the staging assembly and the port, and a port closure assembly, the port closure assembly comprising a closure movable between a port-closed position and a port-opened position, the closure comprising an outer portion and an inner portion, the outer and inner portions cooperating when the closure is in the port-closed position to define a passage in air-flow communication with both the heated zone of the kiln and ambient air, and means for moving the closure between the port-opened and port-closed positions.

17. The apparatus of claim 16 wherein the port closure assembly and the transfer assembly being affixed to the kiln through common points of attachment.

18. The apparatus of claim 16, further comprising a drop tube extending from the port and into the heated zone of the kiln.

19. The apparatus of claim 18, wherein the drop tube is of substantially rectangular cross-section sized to receive a whole tire.

20. The apparatus of claim 16 wherein and the port closure assembly, the transfer assembly, and the drop tube are affixed to the kiln through common points of attachment.

21. The apparatus of claim 16, wherein the transfer assembly comprises guide members positioned to align combustible solids on the transfer assembly with the port.

22. The apparatus of claim 16, wherein the inner and outer portions each include first coplanar plate portions and second non-coplanar plate portions and the air-flow passage is defined by the non-coplanar plate portions.

23. The apparatus of claim 16, wherein the moving means includes a first lever appended to the inner portion, a second lever appended to the outer portion, and means for camming the first and second levers to move the closure to the port-opened position as the kiln rotates through a predetermined arc.

24. The apparatus of claim 16, further comprising first means for yieldably biasing the inner portion toward a position corresponding to the port-closed position of the closure, and second means for yieldably biasing the outer portion toward a position corresponding to the port-closed position of the closure.

* * * * *